US006792704B2

(12) United States Patent
Johnson

(10) Patent No.: US 6,792,704 B2
(45) Date of Patent: Sep. 21, 2004

(54) AIR SPRING ACTUATOR WEIGHT TRANSFER APPARATUS

(76) Inventor: Andrew Harold Johnson, 6445 Delhi Place, Prince George, B.C. (CA), V2N 2N9

( * ) Notice: Subject to any disclaimer, the term of this patent is extended or adjusted under 35 U.S.C. 154(b) by 0 days.

(21) Appl. No.: 10/293,282

(22) Filed: Nov. 14, 2002

(65) Prior Publication Data

US 2003/0101626 A1 Jun. 5, 2003

(51) Int. Cl.[7] ..... E01H 5/04
(52) U.S. Cl. ..... 37/235; 172/261
(58) Field of Search ..... 172/261, 264, 172/265, 810, 817, 816; 37/235, 236, 234, 231, 232, 264, 266, 270, 271; 267/64.21, 64.11, 64.28, 122

(56) References Cited

U.S. PATENT DOCUMENTS 3,689,054 A * 9/1972 Gouirand ..... 267/68
3,883,965 A * 5/1975 Porier et al. ..... 37/232
4,147,448 A * 4/1979 Jeffery ..... 404/124
4,913,070 A * 4/1990 Morrison, Jr. ..... 111/135
5,524,712 A * 6/1996 Balmer ..... 172/311
6,123,156 A * 9/2000 Dufour et al. ..... 172/795
6,145,894 A * 11/2000 Myers ..... 285/322
6,324,775 B1 * 12/2001 Harnois et al. ..... 37/266
6,361,028 B1 * 3/2002 Hubbell ..... 267/64.27
6,378,878 B1 * 4/2002 Vig ..... 280/6.159
6,389,999 B1 * 5/2002 Duello ..... 111/200
6,398,198 B1 * 6/2002 Okamoto ..... 267/64.27
6,402,128 B1 * 6/2002 Trowbridge ..... 267/64.21

* cited by examiner

*Primary Examiner*—Victor Batson

(57) ABSTRACT

This invention relates to using the expansion force of an air spring, coupled between a snowplow vehicle and the attached snowplow, so that contact between ground engaging components of the snowplow and the road can be controlled, either automatically or manually. The air spring is held in alignment as it expands longitudinally, by an apparatus using guides and struts. Longitudinal alignment is important, as bending of the air spring causes loss of force. Attachment points of the apparatus are drawn together, as the air spring expands. The longitudinal expansion force of the air spring can be transmitted directly to a chain or cable.

16 Claims, 5 Drawing Sheets

FIG. 9
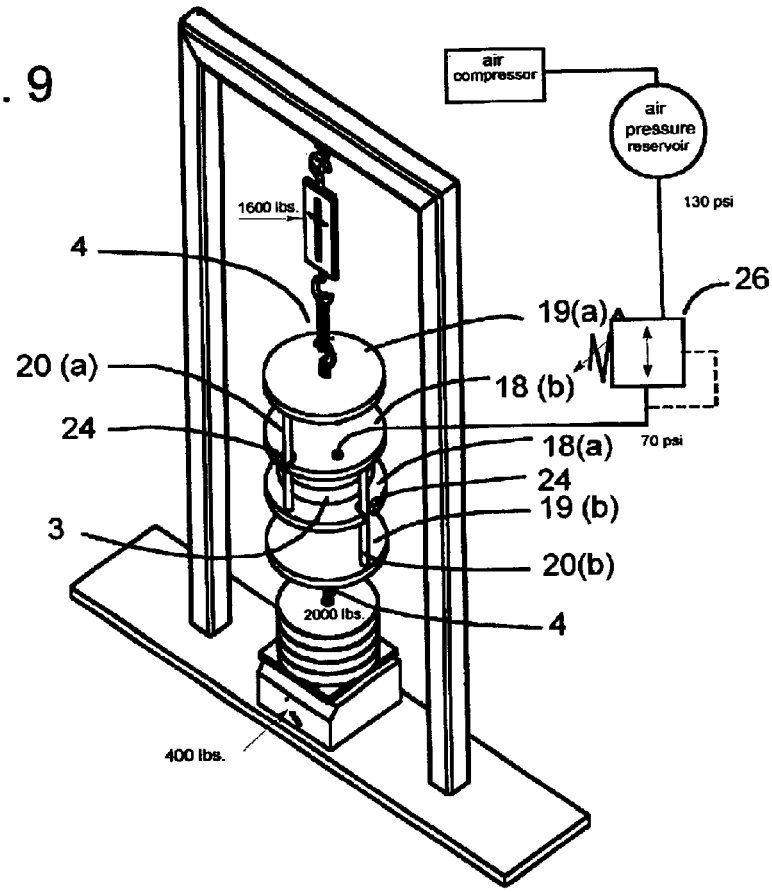
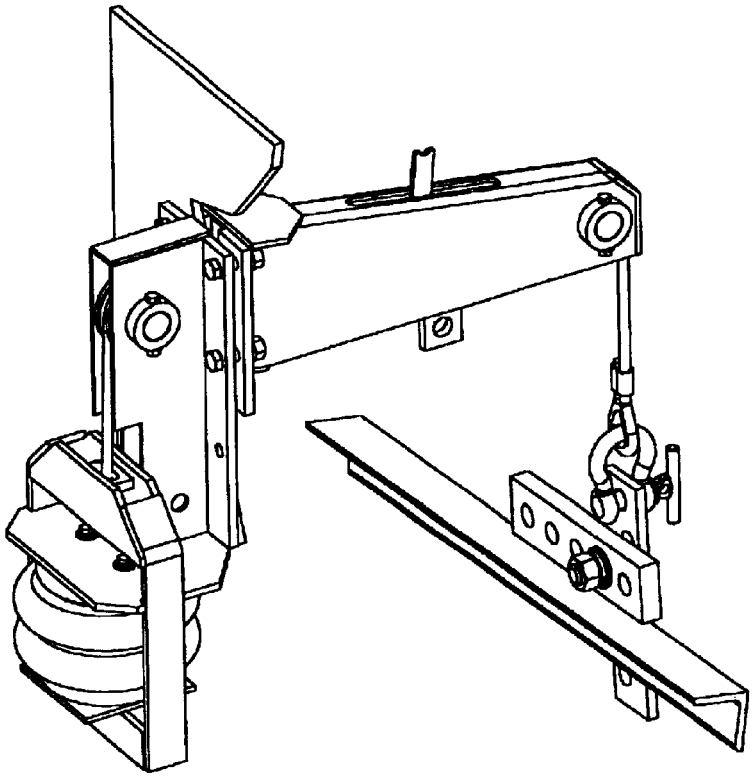
FIG 10

AIR SPRING ACTUATOR WEIGHT TRANSFER APPARATUS

FIELD OF THE INVENTION

This invention relates to using the expansion force of an air spring, coupled between a snowplow vehicle and the attached snowplow, so that contact between the ground engaging components of the snowplow, and the road can be controlled, either automatically or manually.

BACKGROUND OF THE INVENTION

Air springs have long been known, and are widely used in vehicle suspension systems, and have been adapted to other applications as well.

A weight transfer system is disclosed in U.S. Pat. No. 4,314,709 using an air bag, to transfer load from a vehicle to an auxiliary axle thus reducing weight on the main chassis wheels. (Air springs were once referred to as air bags but now the term "air spring" is preferable, to distinguish them from air bags now commonly placed in steering wheels for crash protection)

They have also been used as a means to control tension, as in Canadian Patent CA 1,203,420. A baling machine is disclosed, having a piston moving longitudinally on guides, with the piston displacing air in a air spring as it moves to and fro, rigidly connected to an arm assembly.

U.S. Pat. No. 5,060,334 shows a street sweeper, having air spring means, to control the amount of sweeping pressure a rotary broom exerts on a surface. The system uses a pivot beam with an adjustable air spring at one end of the beam and a boom attached on the other end. As the air spring expands, the beam pivots, lifting or lower the broom.

Air springs have also been adapted to raising and lowering a snowplow scraper blade. As disclosed in U.S. Pat. No. 6,324,775 the operator may vary the air pressure in alternate sets of air springs. By varying the pressure, the amount of force the scraper blade exerts on a surface may be varied. This system requires multiple air springs, and is not suitable for implement attachments which must be quickly removed.

As well the air spring used must be very large to raise a relatively light blade. As disclosed in FIG. 3, frame 17 has no guide means to ensure it remains at right angles to the truck frame, as it is urged upwards in response to air pressure, and thus will tend to cock forward or rearward, as pressure is added to the air spring, greatly reducing its longitudinal force.

Large highway snowplows mounted at the front of a drive vehicle weigh approximately 2,000 pounds, and this weight must closely follow the contour of the road, independent of the drive vehicle. Steel skid-shoes have been, for years, the common means to support a large portion of the weight of the plow.

The normal set-up is to adjust the skid-shoes at approximately the same horizontal plane as the blade, and are adjusted or replaced as the skid-shoes and blades wear out. The plows have become heavier over the years and plowing speeds much faster, resulting in rapid wear. The snowplows blades and shoes normally last for about 8 hours of plowing, before they must be replaced or adjusted. The costs of the blades as well as the skid-shoes, add considerably to the cost of snow removal. As well there is the labour cost to change components, and down-time.

Another problem associated with steel skid-shoes, is the tremendous vibration and road shock they transfer, from the rough road surface to the main body of the snowplow. The jar from every crack and pot-hole is transmitted directly to the plow, resulting in continual breakage, and cracks to the main structure.

Various methods have been used over the years to extend the life of the blades and skid-shoes. Canadian Patent CA 1160043 discloses skid-shoes having carbide inserts, and Canadian Patent CA 2153408 discloses a flexible blade having hardened inserts.

Castor wheels have been used to carry the weight of the plow; however, they can cause vehicle directional control problems. They tend to have a "shopping cart effect" with wheel wobble becoming more pronounced as speed increases.

Wheels fixed in a straight ahead position have been tried, in order to eliminate this problem, however, on slippery roads can cause the dangerous situation of the snowplow steering the vehicle straight ahead when the operator wants to turn.

U.S. Pat. No. 5,265,356 discloses a hydraulic system to regulate the friction between the blade and the road, thus reducing wear. Hydraulic systems, however, are heavy, expensive and complicated to repair and maintain. Also in operation, do not respond quickly enough to the rapidly changing pressure requirements of a snowplow vehicle travelling down the road at 60 KPH.

A mechanical spring device used to control the amount of force an implement attachment exerts on the ground is disclosed in U.S. Pat. No. 5,285,856, which uses a steel cylinder supplied with compressed air, to control the amount of force sugar cane piler tips exert on the ground. To transfer larger weights, however, a steel cylinder of great size and weight is required when using compressed air, which normally operates at a maximum pressure of 130 psi.

Air springs in general are defined as fabric-reinforced rubber bellows, sealed with bead plates, containing a column of compressed air. An air fitting, located in one of the bead plates allows fluid to flow in and out of the bellows. The bead plates also normally have means of bolting the air spring to what ever the air spring is sandwiched between. The air spring is designed such that fluid pressure expands the diameter of the air spring very slightly, while longitudinal expansion is approximately 8 inches for a medium air spring having a diameter of 9 inches. As long as the two bead plates are parallel as the air spring expands, and the expansion is along a straight line, when sandwiched between two members, the longitudinal expansion force of the air spring will tend to force the members apart. However, if parallel alignment is not maintained between the members, and the air spring is allowed to bend as it expands, than longitudinal force pressing against the members will be reduced.

It would be highly desirable to provide a simple means of coupling an air spring directly to a means of force transmission such as cable or chain, so that the expansion force of the air spring could transfer weight from an attached implement to the vehicle.

DESCRIPTION OF THE INVENTION

An air spring actuator, sandwiching an air spring between its interlinked members is disclosed, connecting between a snowplow and the drive vehicle, so that longitudinal expansion of the air spring causes tension, transferring weight from the snowplow to the drive vehicle. One member of an air spring apparatus is mechanically attached to the front push-frame of a snowplow vehicle, while a second moveable member slides longitudinally in guide slots of the attached member, with an air spring sandwiched between the two members. The moveable member can be connected to the snowplow by any mechanical means of force transfer, but flexible means, such as cable or chain are particularly advantageous.

A cable connected to the moveable member travels over a sheave, out over another sheave supported by a boom structure mounted on the front of a push frame, to a desired lift point above the plow, and then coupled at a balance bar, welded to the lower side of the plow's push-frame, such that the weight of the plow is horizontally balanced between the skid-shoes of the snowplow.

The air pressure and thus the amount of cable tension are infinitely adjustable, between zero and the amount of pressure in the vehicle's air pressure reservoir.

The cable is attached to the snowplow at a point approximately two feet from the plow vehicle, while the plow extends forward another six to eight feet. Therefore one inch of vertical movement of the cable causes approximately three inches of vertical movement of the snowplow cutting edge. In addition, the cable is connected at the plows horizontal balance point by a single pin, ensuring that the plow will follow a horizontal plane, so that while tension is maintained on the cable, the snowplow can still follow the ups and downs of the road. When the vehicle travelling down the road encounters a dip, the plow begins to drop, increasing the tension on the cable, which in turn increases air pressure in the air spring. The extra pressure is released to atmosphere by a relieving regulator, returning the system to its pre-set pressure.

Conversely when the plow encounters a rise, the plow is forced up, tension is reduced, air spring pressure drops, and the regulator opens to allow more air pressure to enter the air spring, and the system again returns to it's pre-set pressure. Thus the invention, when properly adjusted, will enable the snowplow vehicle to travel over an uneven surface and still maintain contact, but with reduced wear.

It should be noted that the snowplow weight transfer system in no way interferes with the plow lift system. However, the operator must ensure that the plow lift chains are slack enough when the system is in operation so that they remain slack at all times.

The invention can be adapted to many forms and applications. The air spring, sandwiched between two members that are interlinked like links of a large chain, becomes an actuator that can be coupled directly between any two objects. It may be used in place of a hydraulic actuator, is lighter and less expensive than a hydraulic actuator and requires no maintenance.

BRIEF DESCRIPTION OF THE DRAWINGS

FIG. 9 is a demonstration of the invention causing weight transfer FIG. 10 is a representative drawing

DESCRIPTION OF A PREFERRED EMBODIMENT

Figure 1:
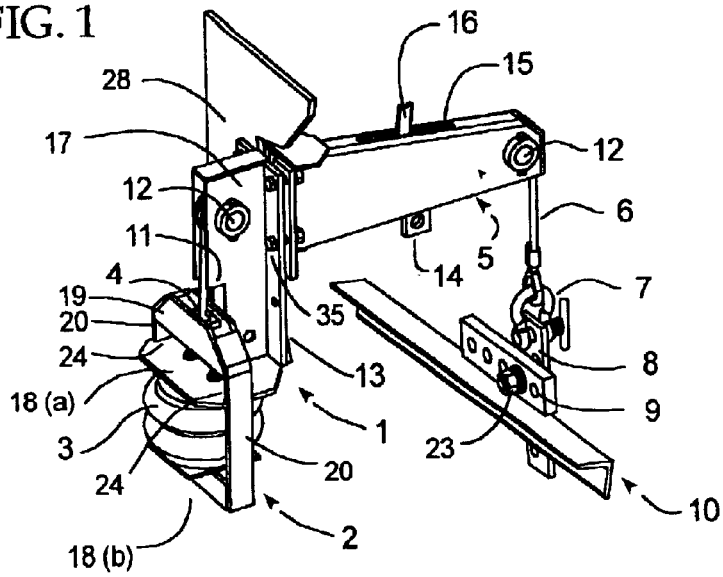
FIG. 1 is a perspective view of the invention, having a boom structure to suspend a balance beam.
Figure 2:
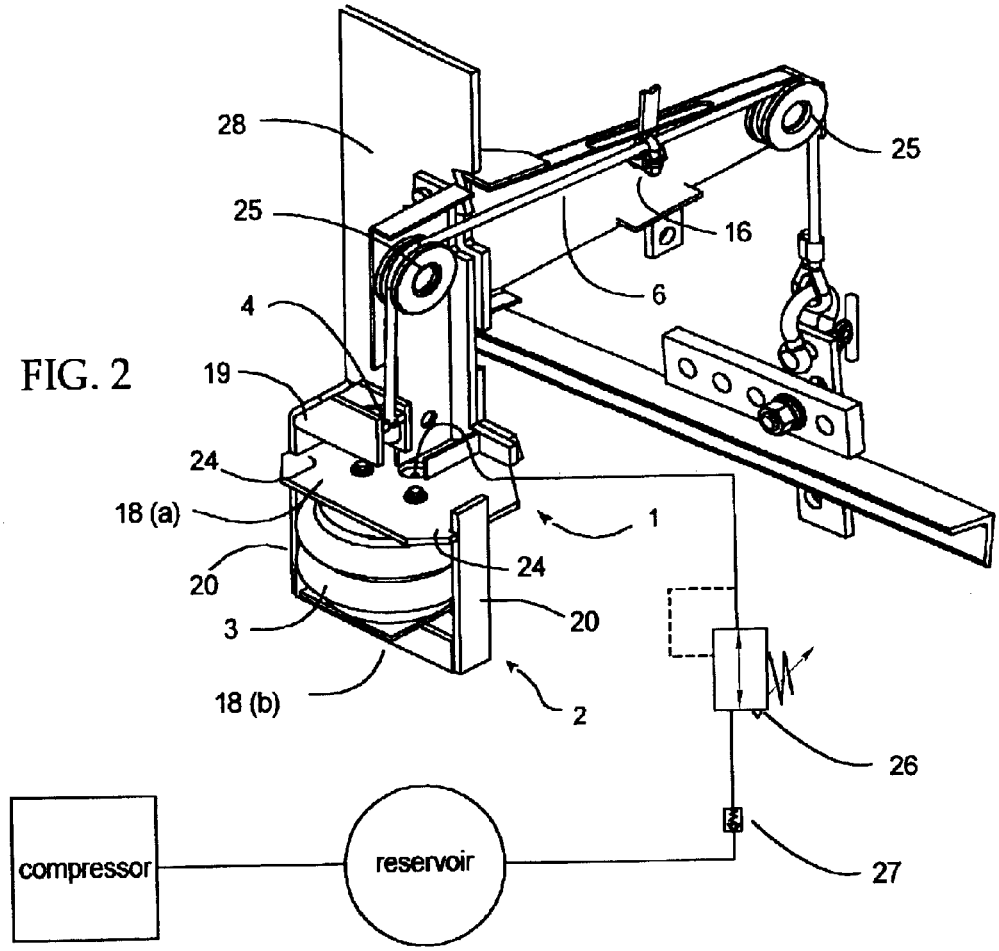
FIG. 2 is a perspective view of the invention, with portions cut-away and a schematic of an air pressure supply.
Figure 3:
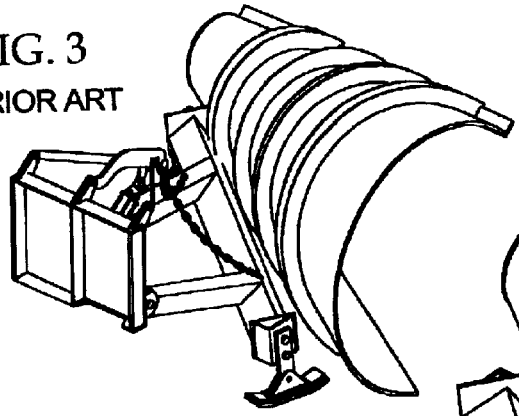
FIG. 3 PRIOR ART
FIG. 3 is prior art showing a typical snowplow arrangement adapted to be mounted on the front of a large truck

A preferred embodiment of the invention is illustrated by FIG. 1 & FIG. 2 showing fixed member 1 attached to plate section 28 with bolts 35. The fixed member is an assembly of parallel plates 17, vertical plate 13, and header plate 18(*a*)which have been welded together to form an L shaped bracket. Header plate 18(*a*) has guide notches 24 to engage struts 20 of moveable member 2. Sandwiched between moveable member header plate 18(*b*) and fixed member header plate 18(*a*) is air spring means 3.

Moveable member 2 is free to slide longitudinally within the confines of header plate 18(*a*) and upper stop 11 and guide notches 24. The guides and struts ensure that the headers remain generally parallel and in alignment, and the air spring end plates parallel, so that the air spring expansion will be substantially longitudinal. Any deviation from longitudinal reduces the force of the air spring at a given pressure. Bolts 35 extend through boom structure 5 sandwiching mounting plate 28 between the fixed member 1 and the boom structure 5.

Mounting plate 28 is a section of plate rigidly attached to any stationary member of any machine or vehicle. A typical example shown in FIG. 4 where the vertical plate of truck push-frame 36 is sandwiched between fixed member 1 and boom structure 5. Cable 6 is mechanically connected at attachment 4 to moveable member 2 at one end, is supported by sheaves means 25 held in boom structure 5 by pins 12. Cable 6 is further connected to cable adjustment link 8 at the opposite end by clevis 7.

Cable adjustment link 8 is connected to horizontal balance bar 10 by bolt 23. The cable, clevis, and bolt form, in combination, a mechanical means of force transmission between attachment 4 and horizontal balance bar 10. Guides 24 ensure that struts 20 remain approximately at 90 degrees to header plate 18 as tension increases on cable 6.

Horizontal balance bar 10 has plurality of holes 9 provided to adjust the horizontal balance point of an implement attached to a vehicle. Adjustment link 8 is provided to adjust the position of moveable member 2 with indicator 16 positioned on cable 6 so that it is in the middle of slot 15 when moveable member 2 is in the middle of its longitudinal stroke between header plate 18 and stop 11. Tie back 14 is provided as an alternate connection of clevis 7, when an implement attachment is removed from the vehicle.

Air pressure is supplied from a reservoir of compressed air as shown in the schematic of FIG. 2 and controlled to air spring 3 by relieving regulator 26. System protection valve 27 protects the vehicle against loss of pressure.

Figure 4:
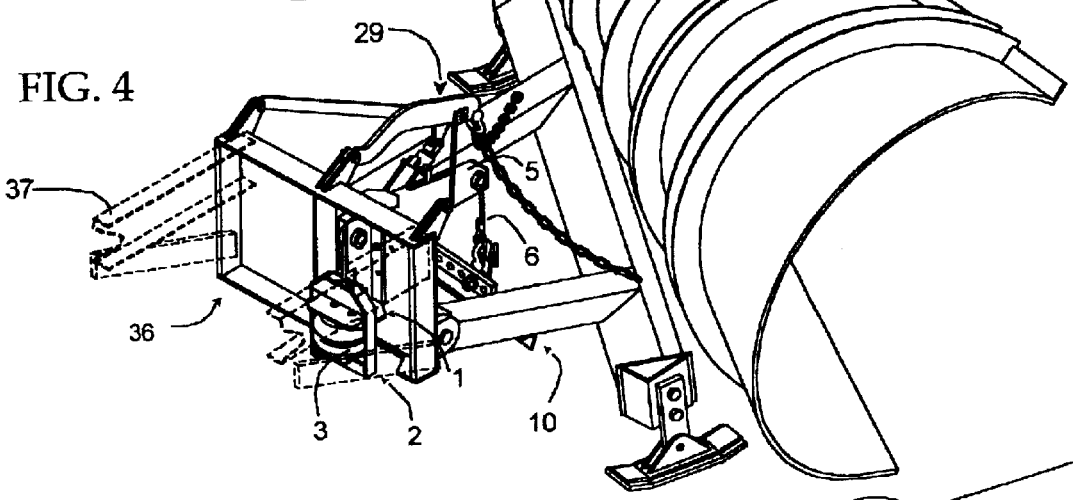
FIG. 4 is a perspective view of the invention, installed on a typical prior art snowplow arrangement
Figure 5:
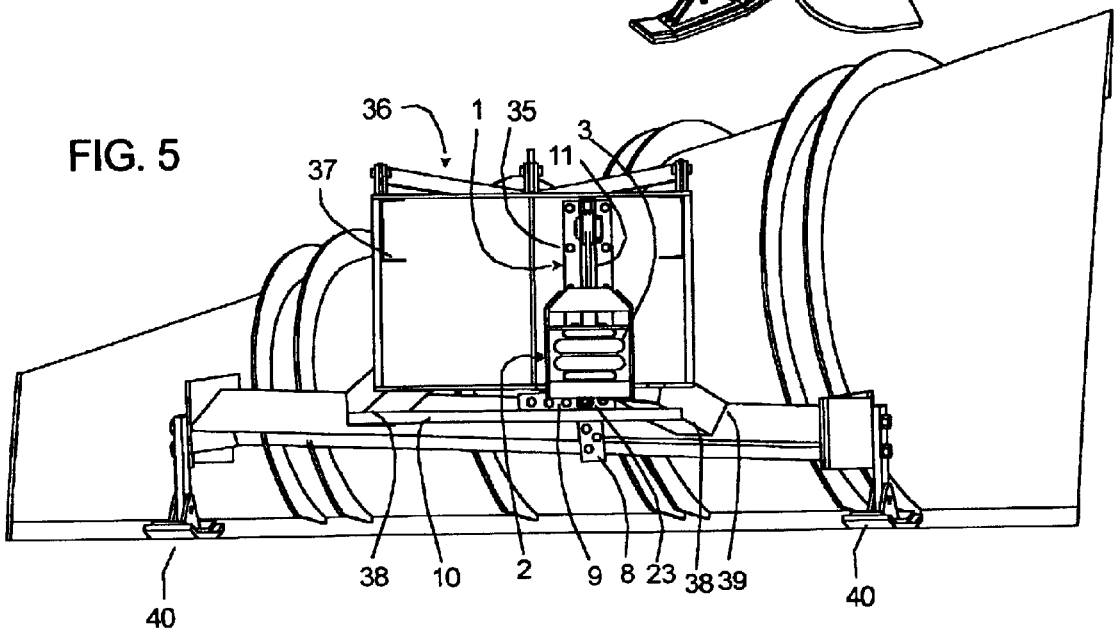
FIG. 5 is a rearward view of the invention, installed on a typical prior art snowplow arrangement FIG. 6(*a*) is a side view of the invention on a snowplow truck and its attached plow, as the plow pivots downward following a slope, with a schematic of the air pressure regulating system FIG. 6(*b*) is a side view of the invention on a snowplow truck and its attached plow, on level ground FIG. 6(*c*) is a side view of the invention on a snowplow truck and its attached plow, as the plow pivots upward, going up a slope

Referring now to FIG. 4 & FIG. 5 showing the invention attached with bolts 35 on a truck push-frame 36 with horizontal balance bar 10 welded to plow-frame at 38 and with push-frame 36 mounted on a vehicle (not shown) having frame-rails 37.

FIG. 5 shows a rearward view of a typical snowplow arrangement as it mounts on frame-rails 37 extending to the front of a heavy duty snowplow vehicle, with an embodiment of the invention installed on the right side of truck push-frame 36. Skid-shoes 40 although carrying very little or no weight, remain on the snowplow for safety and for parking the snowplow, when it is removed from the vehicle. Balance bar bolt 23 is installed in the balance adjustment holes 9 so that the weight of the plow is balanced on a horizontal plane. Balance bar bolt 23 at the same time is installed in the appropriate hole of adjustment link 8 so that with the vehicle on level ground moveable member 2 is in the middle of its stoke between upper stop 11 and header plate 18.

Figure 6:
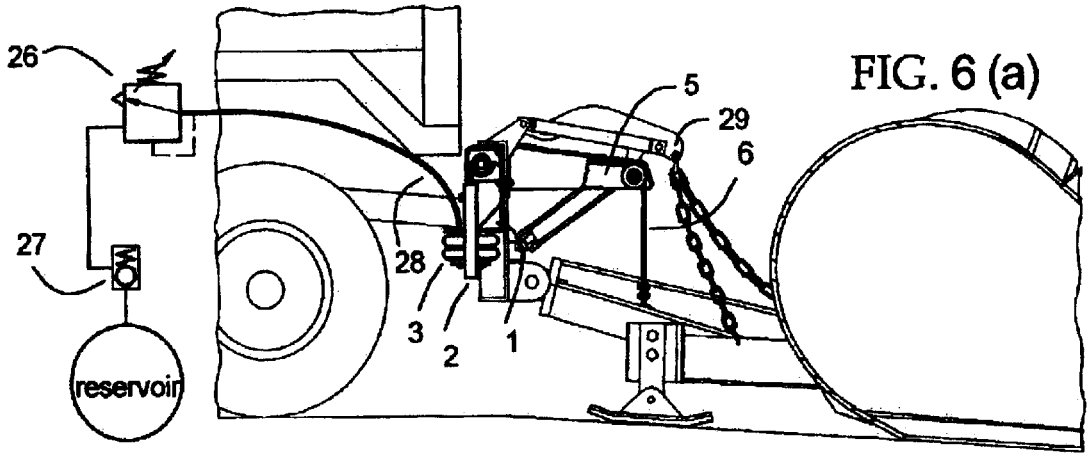
Figure 6:
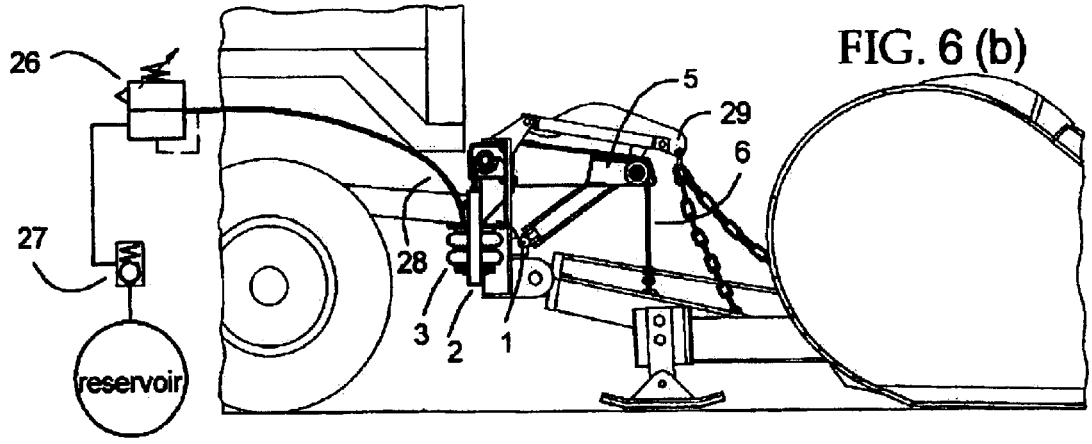
Figure 6:
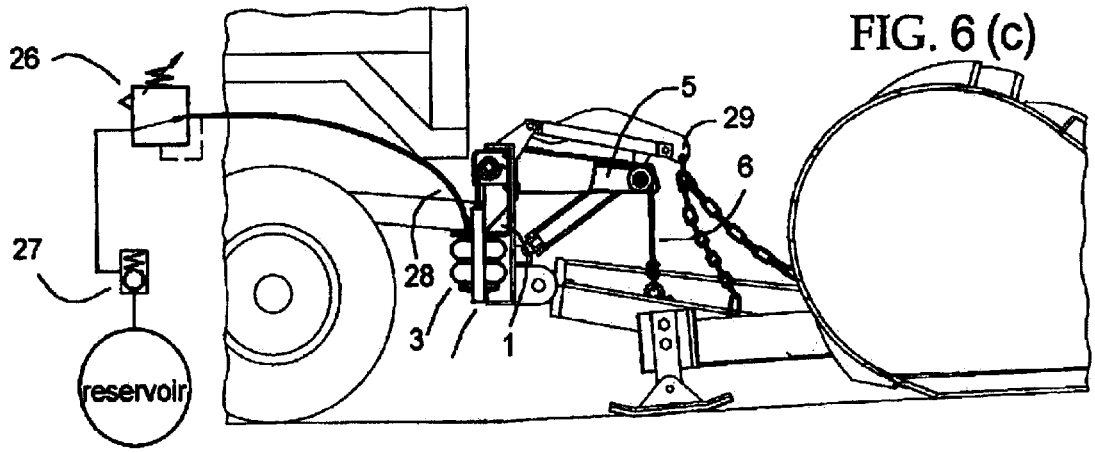

FIGS. 6(*a*)(*b*)(*c*) show the invention installed on a snowplow vehicle, with the moveable member 2 in three different positions as it moves slidably within the confines of fixed member 1.

FIG. 6(*a*) shows the snowplow on a different plane than the drive vehicle as it goes down slope. Air spring actuator 3 sandwiched between moveable member 2 and fixed member 1 has been supplied air pressure from the vehicle reservoir by relieving regulator 26. Cable 6, connected to balance bar 10, as shown in FIG. 5, and moveable member 2 at the other end, is pulled tighter as the plow begins down the slope.

This pulling or tension is transferred to the movable member, pulling it or forcing it to move up, by the weight of the plow as it starts to become suspended. As the moveable member 2 moves up, or longitudinally, air spring 3 is concurrently compressed, increasing the air pressure inside the air spring. The pressure increase reacts on relieving regulator 26, which exhausts the increased pressure, to maintain the pressure in the air spring at its pre-set value.

FIG. 6(*b*) shows the vehicle on level ground. Regulator 26 maintains system pressure at its pre-set value and moveable member 2 is in the middle of its stroke. Pressure in the air spring is adjustable according to the weight of the implement attachment and the amount of friction desirable between the attachment and the ground.

It has been found that for a typical large heavy duty snowplow a pressure setting between 65 psi and 75 psi with an air spring having a diameter of 9 inches will allow the snowplow to automatically follow the uneven road surface, while still scraping the snow from the road surface. If the operator wants to increase the cutting action of the plow, they simply adjust the relieving regulator to decrease the pressure in the air spring. By increasing the pressure, wear on ground engaging components is decreased.

Although the invention may be used as an implement lifting mechanism in some applications, in this particular application it is being used as an apparatus to transfer weight from, in this case a snowplow to the vehicle. The amount of weight transferred from the snowplow to the drive vehicle is ultimately transferred to the wheels of the drive vehicle. Lift mechanism 29 of prior art lifts the plow up and down and the operator must ensure that it is lowered sufficiently so that the plow can freely follow an uneven surface.

FIG. 6(*c*) shows the vehicle as the plow travels up a slope, with the drive vehicle and the plow on different planes. As the plow is forced up by the ground surface, tension in cable 6 decreases and moveable member begins to move downward as air spring 3 expands longitudinally. The pressure in the air spring starts to decrease, regulator 26 opens to reservoir and pressure is supplied to the air spring, to maintain system pressure and tension in cable 6.

DESCRIPTION OF ALTERNATE EMBODIMENTS

FIG. 9 shows an embodiment of the invention used as a coupling means between two objects, a large fish scale and a weight sitting on a platform scale.

Air spring means 3 is sandwiched between opposing headers 18(*a*) & 18(*b*) and is fluidly connected to relieving pressure regulator 26, and as shown in the demonstration contains 70 psi. Header 18(*a*) is linked to cross member 19(*a*) by strut 20(*a*) to form, in combination, one link of the apparatus. Header 18(*b*) is linked to cross member 19(*b*) by strut 20(*b*) to form a second link of the apparatus.

Guides 24 slidably engaged with struts 20(*a*) and 20(*b*) ensure that the two interlinked members remain approximately parallel, as air spring 3 expands longitudinally, in response to pressurized fluid, urging the two interlinked members apart. As the two opposing headers are urged apart by the longitudinal expansion of the air spring, opposing attachments 4 are concurrently urged towards the opposing headers, thus causing tension or pulling in the connection means between the large fish scale and the weight. As shown in the demonstration, this pulling or tension, caused longitudinal expansion force of the air spring has transferred 1600 lbs. to the beam and 400 pounds remain on the platform scale.

Figure 7:
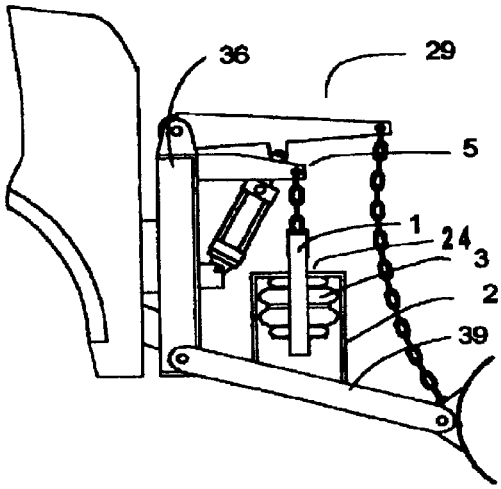
FIG. 7 is an alternate embodiment of the invention mainly for lighter plows

FIG. 7 shows an embodiment of the invention for use with a lighter snowplow. Fixed member 1 is connected to boom structure 5 with the boom structure rigidly attached to truck push-frame 36. Guides 24 of moveable member 2 slide longitudinally in relation to fixed member 1 in response to longitudinal expansion of air spring 3. Moveable member 2 is mechanically connected to plow push-frame 39 such that longitudinal expansion of the air spring causes weight to be transferred from snowplow push-frame 39 to boom structure 5.

Figure 8:
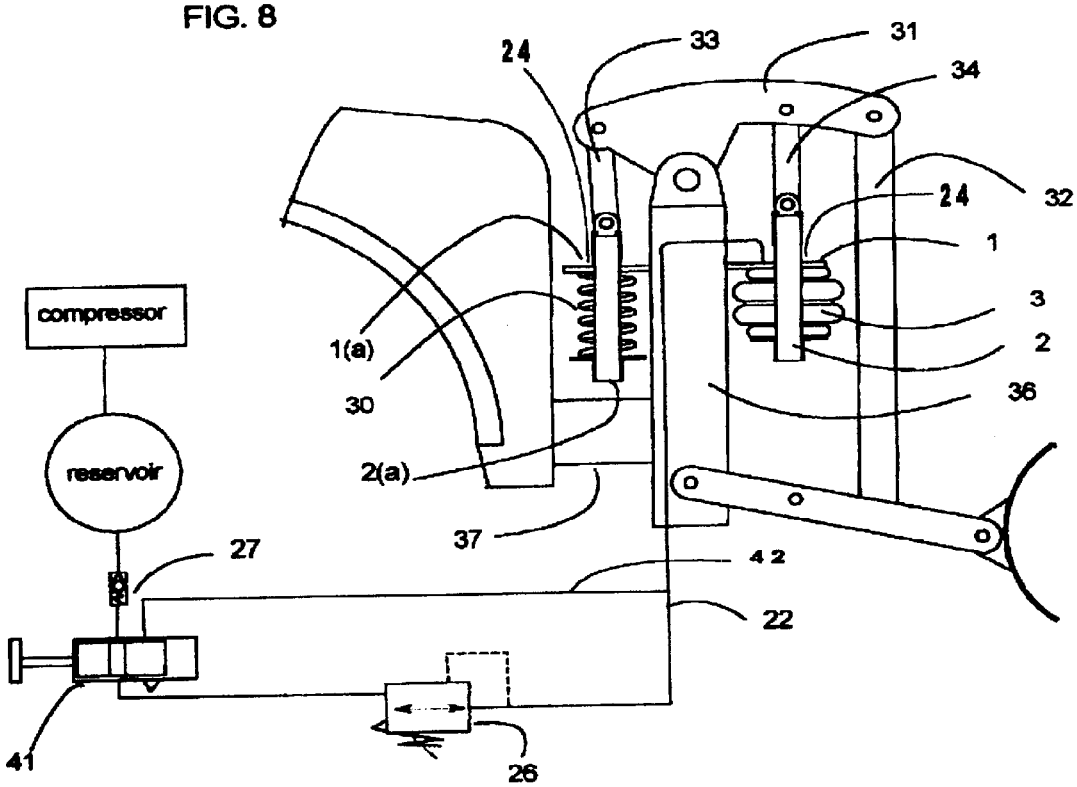
FIG. 8 is an alternate embodiment of the invention mainly for lighter plows, having a mechanical spring to lift the plow and an air spring to control down force

FIG. 8 shows another embodiment suitable for use with a lighter plow such as for use on a pick-up truck. A lever is pivotably attached to truck push-frame 36, with the forward side of the lever linked to a plow by link 32 and the rearward side of the pivot linked to moveable member 2(*a*) by link 33. Guide 24 ensures that moveable member 2(*a*) remains approximately at right angles to fixed member 1(*a*) when mechanical spring 30 is compressed. Air spring 3 is sandwiched between fixed member 1 and moveable member 2 with guide means 24 ensuring that moveable member 2 remains approximately at right angles to fixed member 1 as air 3 expands longitudinally in response to air pressure supplied by relieving regulator 26 through tube 22.

In operation the system is supplied air pressure through control valve 41 from a reservoir with valve 27 protecting the reservoir against pressure loss. When the pressure in air spring 3 is great enough to overcome the force of mechanical spring 30, the snowplow pivots downward. The amount of force the plow exerts on the ground is controlled by relieving regulator 26. When the operator wants to lift the plow, valve 41 is moved to a second position and system pressure is exhausted through tube 42. The force of mechanical spring 30 lifts the plow.

That which is claimed is:

1. An air spring actuator apparatus comprising:

a) an air spring means comprising flexible bellows having bead plates that that contain a column of air pressure b) an air pressure control means comprising a valve adapted to control air pressure c) two independent members, comprising a header means and an attachment means, the header means positioned at opposite ends of the air spring means, said header means oppose longitudinal expansion of said air spring means, at least one of said header means having a guide means, at least one of said header means having a strut means, the strut means affixed rigidly and substantially at 90 degrees to said header means, at least one of said strut means engaging the opposing header guide means and extending beyond said opposing header guide means to the attachment means, said strut means ensuring substantial alignment of said header means, whereby longitudinal expansion of said air spring means, in response to pressurized fluid, urges said header means apart, while concurrently said attachment means of one header means moves towards the opposing header means.

2. The air spring actuator apparatus of claim 1 wherein said guide means comprises an opening in said header, said opening adapted to relate closely with said strut means, whereby said strut means remains substantially at right angles to said header means, as said strut means slidably engages said opening.

3. The air spring actuator apparatus of claim 1 wherein said strut means comprises rigid material attached rigidly and substantially at right angles to said header, said strut means adapted to cooperate with openings in said opposing header means, said strut means of sufficient length to connect said header means to an attachment point beyond said opposing header means, as well as form a cavity between said header means, as well as allow said header means to move towards and away from said opposing header means, said strut means adapted to maintain substantial alignment between said header means.

4. The air spring actuator apparatus of claim 1 wherein said attachment means comprises material adapted to couple a mechanical means of force transmission and selected from the group consisting of chain, cable, wire, rope, wire rope, clevis, pin, bolt, metallic material, fibrous material, hard material, soft material, rubber, steel, wood, manufactured material, natural matter and manufactured matter whereby mechanical force can be transmitted.

5. The air spring actuator apparatus of claim 4 wherein said mechanical means of force transmission comprises material of sufficient strength to transfer said force and selected from the group consisting of chain, cable, wire, rope, wire rope, clevis, pin, bolt, metallic material, fibrous material, hard material, soft material, rubber, steel, wood, manufactured material, natural matter and manufactured matter whereby mechanical force can be transmitted.

6. The air spring actuator apparatus of claim 5 further including a horizontal balance means, the horizontal balance means comprising a rigid structure whereby the horizontal balance of an object can be advantageously adjusted.

7. The air spring actuator apparatus of claim 6 further including a boom structure means, said boom structure means comprising a rigid projection attached to a motorized vehicle whereby a mechanical means of force transmission connected between said motorized vehicle and an implement is supported.

8. The air spring actuator apparatus of claim 7 comprising a motorized vehicle adapted for attached implements.

9. The air spring actuator apparatus of claim 8 comprising said motorized vehicle adapted to plow snow.

10. The air spring actuator apparatus of claim 9 comprising a pivot means, the pivot means being a rigid structure pivotably mounted on the motorized vehicle, said pivot means adapted to connect one end of said air spring actuator apparatus to said motorized vehicle, the other end of said pivot means adapted to connect said air spring actuator apparatus or optionally connect mechanical spring means whereby mechanical force on one end of said pivot means is a biasing force to the opposite end of said pivot means, the biasing force controlled by air pressure within said air spring actuator apparatus.

11. A weight transfer system comprising:

a) an air spring means, comprising flexible bellows having bead plates, the air spring means containing a column of fluid pressure b) an air pressure control means the pressure control means comprising a mechanical device adapted to control fluid pressure contained within said air spring means c) an air spring attachment means, the air spring attachment means comprising a fixed member and a moveable member, the fixed member comprising an attachment means and a header means, the moveable member comprising an attachment means and a header means, the fixed member adapted to attach to a motorized vehicle, the moveable member adapted to couple to an attached implement, said moveable member further comprising a strut means, the strut means slidably moveable in relation to said fixed member, said strut means rigidly attached substantially at right angles to the moveable member header means, said fixed member further comprising a guide means, the guide means adapted to substantially maintain alignment between said fixed member and said moveable member, the attachment means of said moveable member adapted to connect a mechanical means of force transmission, the moveable member attachment means adapted to move towards said fixed member in response to longitudinal expansion of said air spring, said moveable member attachment means connecting the mechanical means of force transmission whereby longitudinal expansion of said air spring means concurrently urges said moveable member attachment means towards said fixed member, transferring weight from an attached implement to a motorized vehicle.

12. The weight transfer system of claim 11 further including a boom structure means, comprising a rigid projection adapted to support a means of force transmission.

13. The weight transfer system of claim 12 comprising a rigid structure whereby the horizontal balance of an object can be adjusted.

14. The weight transfer system of claim 13 wherein said attachment means comprises material adapted to couple a mechanical means of force transmission and selected from the group consisting of chain, cable, wire, rope, wire rope, clevis, pin, bolt, metallic material, fibrous material, hard material, soft material, rubber, steel, wood, manufactured material, natural matter and manufactured matter whereby mechanical force can be transmitted.

15. In a snowplow vehicle, an air spring apparatus comprising:

a) a snowplow vehicle comprised of a front mounted push-frame the front mounted push-frame comprising rigid attachment means to the front frame section of said snowplow vehicle, said front mounted plow push-frame comprising rigid structure adapted for snowplow attachment.

b) a snowplow means comprising a mouldboard and a push-frame, the snowplow means adapted to scrape snow from a ground surface, said snowplow attached to the snowplow vehicle c) an air spring, comprised of a flexible bellows having bead plates, the air spring containing a column of compressed air d) an air pressure supply means comprising an air compressor, the air pressure supply means further comprising air pressure tubing e) air pressure control means comprising a valve adapted to regulate air pressure f) a force transfer means, the force transfer means comprising an air spring attachment means, the air spring attachment means comprising a fixed member and a moveable member, the fixed member comprising an attachment means and a header means, the moveable member comprising an attachment means and a header means, the fixed member adapted to attach to said snowplow vehicle, the moveable member adapted to couple to said snowplow, said moveable member further comprising a strut means slidably moveable in relation to said fixed member g) said strut means rigidly attached substantially at right angles to the moveable member header means, said fixed member further comprising a guide means, said guide means adapted to substantially maintain alignment between said fixed member and said moveable member, the attachment means of said moveable member adapted to connect a mechanical means of force transmission, the moveable member attachment means adapted to move towards said fixed member in response to longitudinal expansion of said air spring, said attachment means connected the mechanical means of force transmission whereby longitudinal expansion of said air spring means concurrently urges said attachment means towards said fixed member, transferring weight from said snowplow to said snowplow means vehicle h) a boom structure means comprised of a rigid elongated rectangular tube projection rigidly attached to said snowplow vehicle, the projection substantially horizontal i) a balance bar means comprised of a rigid bar, said bar attached at right angles to the snowplow push-frame, said balance bar means comprising a plurality of holes whereby the horizontal balance of said snowplow can be advantageously adjusted.

16. In a snowplow vehicle, an air spring apparatus of claim 15 comprising;

a) a fixed member, said fixed member mechanically attached to said snowplow vehicle, said fixed member comprising a rectangular L shaped bracket comprising a vertical leg and a header plate, the vertical leg mechanically attached to the vehicle, said header plate comprising holes to attach said air spring on a lower side of said header plate with bolts, said header plate comprising an opening adapted to accommodate said air spring being fluidly connected to air pressure, said header plate having a guide notch adapted to engage a moveable member, the bracket further comprising parallel plates welded near a vertical center line, forming a reinforcement gusset between the vertical leg and the header plate, the parallel plates spaced apart and comprising a hole bored through to accommodate a sheave near a top of said vertical leg b) said moveable member comprising a frame adapted to accommodate said air spring within the confines thereof, mechanically engage guides of said fixed member, and allow for longitudinal travel of the frame within the confines of said guides and stops, said frame comprising a rectangular shape formed with flat bars, the long sides of the rectangular frame engaging the guide slots of said horizontal member, the short sides of said rectangular frame comprising parallel bars welded to the long sides, the parallel bars comprising said header plate on one end with holes to mechanically attach said air spring with bolts, and further comprising parallel bars on the opposite end comprising a notch to attach a cable, said air spring sandwiched between the moveable member header plate and the fixed member header plate, the cable connected to the snowplow whereby longitudinal expansion of said air spring causes tension in said cable, the tension transferring weight from the snowplow to the snowplow vehicle c) a boom structure means comprising a rigid elongated rectangular tube projection rigidly attached to said snowplow vehicle, the projection substantially horizontal, said projection relatively narrow on its horizontal plane, said projection relatively wide on its vertical plane, said projection having attachment means for rigid attachment to said snowplow vehicle, said projection extending outward from said snowplow vehicle to a point above said snowplow whereby said cable can be attached to said snowplow, said projection having a sheave to support said cable above said snowplow d) an air pressure regulator means comprising a relieving regulator valve, the relieving regulator valve adapted to control air pressure.

* * * * *